US006227740B1

(12) United States Patent
Stear et al.

(10) Patent No.: US 6,227,740 B1
(45) Date of Patent: May 8, 2001

(54) SCRUBBING IMPLEMENT

(76) Inventors: Roger K. Stear, 180037 Ridgeway Dr., Mitchell, NE (US) 69357; John C. Lewis, Jr., P.O. Box 146, Forest Dale, VT (US) 05745

( * ) Notice: Subject to any disclaimer, the term of this patent is extended or adjusted under 35 U.S.C. 154(b) by 0 days.

(21) Appl. No.: 09/453,495

(22) Filed: Dec. 3, 1999

(51) Int. Cl.[7] ..... A46B 11/02; B43K 5/02

(52) U.S. Cl. ..... 401/188 R; 401/139; 401/187; 401/190; 401/288; 401/289

(58) Field of Search ..... 401/137, 139, 401/187, 188 R, 190, 270, 288, 289, 290; 222/324, 383.1; 239/333, 329; D23/225

(56) References Cited

U.S. PATENT DOCUMENTS 4,848,946 * 7/1989 Goncalves ..... 401/190
4,922,859 * 5/1990 Durell et al. ..... 401/139
5,885,019 * 3/1999 Stear ..... 401/137
6,092,952 * 7/2000 Eberle ..... 401/139

* cited by examiner

*Primary Examiner*—David J. Walczak
*Assistant Examiner*—Tuan Nguyen
(74) *Attorney, Agent, or Firm*—Donald C. Casey

(57) ABSTRACT

A scrubbing attachment for a hand held pump dispenser having a rotatable nozzle cap threadedly received on the pump nozzle stem is described. The attachment has a back face having a central channel with internal threads, adapted to be substituted for the nozzle cap, and a front face with a pinhole extending axially into the channel and a plurality of tufts extending outwardly from the surface of the front face.

5 Claims, 2 Drawing Sheets

FIG. 1
(PRIOR ART)
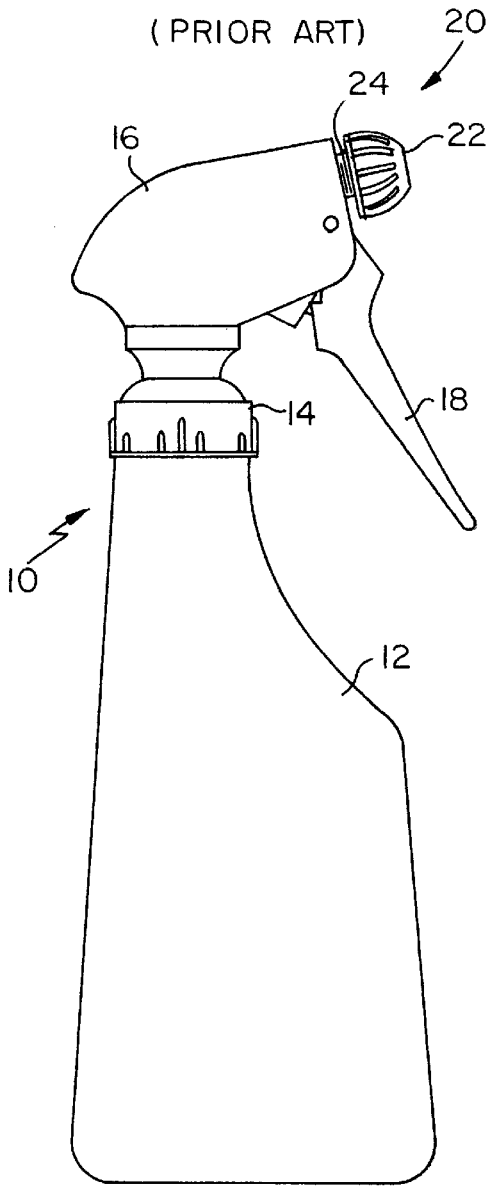
FIG. 2
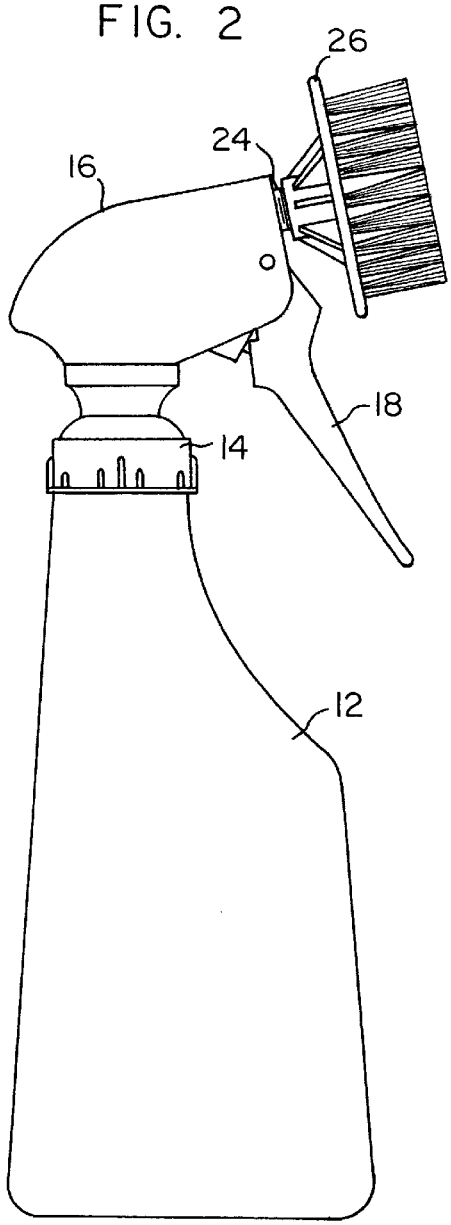
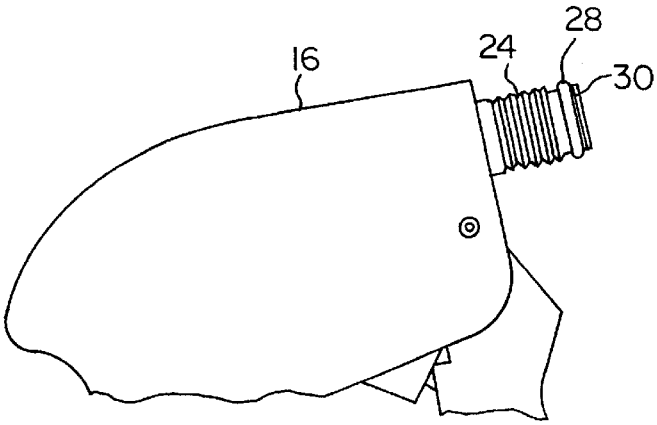
FIG. 2A

SCRUBBING IMPLEMENT

FIELD OF THE INVENTION

This invention relates to a hand scrubbing implement, and in particular to a brush attachment for an conventional spray bottle so that cleaning material can be dispensed onto a surface and the surface scrubbed with the same hand.

DESCRIPTION OF THE PRIOR ART

Plastic spray bottles which use a hand held pump are well known for a variety of different uses. Commercially available spray bottles may be used domestically, for example, to water plants, dispense insecticide or dispense a liquid cleaning material. Commercially available plastic bottles typically have the capacity of about one quart or less, and have a pump attachment threadably received on the bottle top so that when a trigger is squeezed on the pump liquid from the within the bottle will be dispensed through the nozzle. These pump attachments typically have a threaded cap on a dispensing nozzle so that the stream dispensed can be regulated from a fine mist to a spray, to an actual stream. The cap has an axially arranged pin hole which registers on an internal nozzle so that as the cap is rotated into the nozzle the spray will become finer.

Because the bottle is plastic it is usually desirable to admit air as the liquid is dispensed, so that the bottle will not collapse. In certain of these commercially available devices, however, the dispensing opening remains open even when the cap is completely threadably received on the bottle. (See for example U.S. Design Pat. No. 275,456; U.S. Pat. No. 5,641,125 and U.S. Pat. No. 5,526,985.)

On the other hand, certain pumps, such as that disclosed in U.S. Pat. No. 4,489,890, use a flexible cup disposed within the cap surrounding the dispensing opening so that the opening is normally closed, except when the trigger is depressed actuating the pump. In this type of device, if the bottle is overturned, it will not leak.

In a typical cleaning activity the cleaning material is dispensed onto a surface and then a scrubbing device is used. A number of prior patents have been directed to providing liquid applicators within different types of scrubbing devices. A number of patents describing such prior art devices are listed in U.S. Pat. No. 5,885,019.

That patent describes a brush attachment for a conventional spray bottle. The brush consists of a brush back with a central hole therethrough and the brush back is friction fitted on the bottle's nozzle cap. The spray from the dispenser, depending upon the position of the nozzle cap, can either inject a mist into the brush or a stream passing directly through the brush onto the surface to be cleaned.

For many years, brushes have been constructed using the staple set method wherein individual tufts are held in apertures in a brush back by staples.

Brushes have also been made wherein synthetic filaments tufts are picked, and the end of the tuft fused and then attached to a synthetic brush back to form a brush having tufts integral with the back. U.S. Patents assigned to Tucel Industries, Inc. disclose a number of brush backs with integral tufts. Examples of such patents are U.S. Pat. Nos. 3,604,043; 4,189,189; 4,291,431; 4,348,060; 4,690,277 and 4,693,519. The listed patents are merely examples of Tucel Industries products and the foregoing is not intended to be an exhaustive list of such patents. The disclosures of the above Tucel patents are hereby incorporated by reference.

SUMMARY OF THE INVENTION

It has been discovered that a tufted brush construction can be mounted on a convention pump dispenser bottle replacing the nozzle cap by providing such a brush implement with a central hole therein and internal threads so that the brush may be threadably received on the pump dispenser in place of the conventional cap. The brush itself then can be used to regulate the spray from the bottle, and also used as a brushing implement on a surface to be cleaned. The attachments includes a base member having a topface mounting a plurality of tufts and a bottom face. A communication channel extends through a base member and the channel is internally threaded. The top face of the channel forms a pinhole to dispense liquid and the bottom face of the channel is designed to be threadably received on the nozzle of the pump dispenser. The nozzle of the pump dispenser typically has a groove and an O-ring mounted therein to frictionally engage the internal surface of the channel as the brush is rotated onto the dispenser nozzle. In this way the brush will not inadvertently rotate as it is used as a scrubbing implement.

Accordingly, it is an object of this invention to provide a hand held scrubbing implement wherein a brush is mounted on a pump dispenser nozzle.

It is another object of this invention to provide a light weight plastic scrubbing implement wherein liquid can be dispensed through a brush as the brush is used for scrubbing a surface to be cleaned.

It is another object of this invention to provide an improved scrubber attachment for a spray bottle which uses a hand pump as a source of air pressure to dispense liquid wherein the scrubber attachment regulates the flow of liquid from the spray bottle.

It is still another object of this invention to provide a lightweight and efficient scrubber attachment for a conventional hand pump spray bottle wherein the scrub brush is a brush back with integral tufts extending therefrom which is threadably received on the dispensing nozzle of the hand operated pump.

These and other objects of the invention will become readily apparent with reference to the drawings and following description wherein:

BRIEF DESCRIPTION OF THE DRAWINGS

FIG. 1 is a side view of a conventional sprayer bottle,

FIG. 2 is a side view of the bottle of FIG. 1 with the scrubber attachment of this invention mounted thereon.

FIG. 2A is a fragmentary view of the pump dispenser for the bottle of FIG. 1 with the nozzle cap removed.

DETAILED DESCRIPTION OF THE INVENTION

Figure 3:
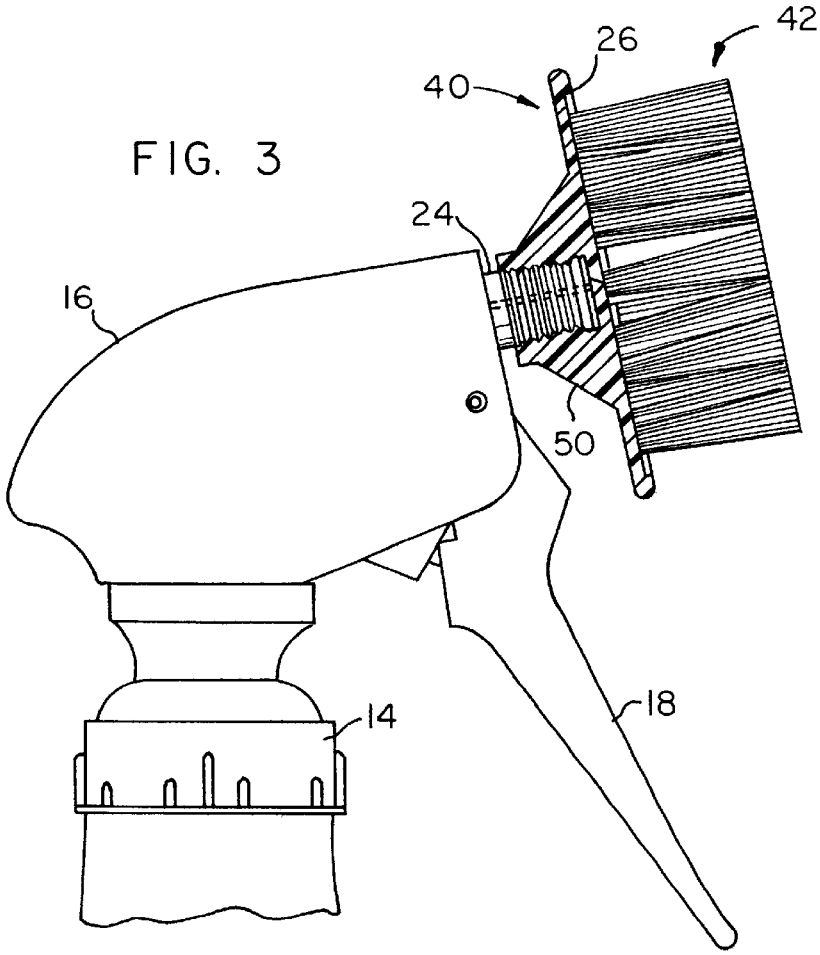
FIG. 3 is a fragmentary view of the bottle of FIG. 2 in partial cross section.
Figure 4:
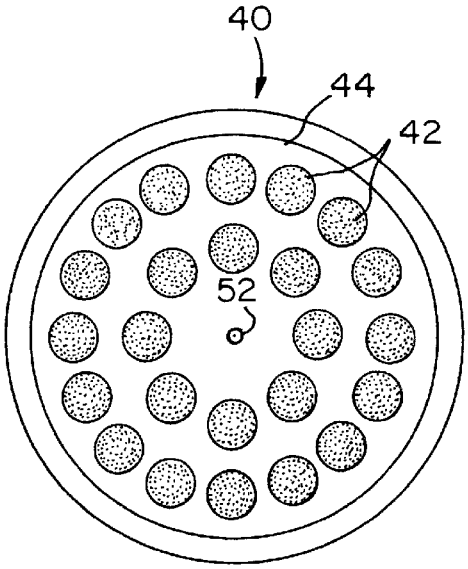
FIG. 4 is a front view of the scrubbing attachment of FIG. 3.

With attention to FIG. 1, the hand pump spray bottle 10 shown is a conventional bottle and FIG. 1 is intended to be illustrative only. The bottle 10 typically has a reservoir 12 which may be clear plastic and typically holds about one quart, or less, of liquid. The bottle 12 has a threaded cap 14 which mounts a pump 16 having a hand actuated trigger 18. When the trigger 18 is squeezed in conventional operation liquid from within the bottle will be pumped by the pump 16 and dispensed from a nozzle 20. The nozzle 20 includes a threaded cap 22 which has a central pinhole opening (not shown) for controlling liquid dispensed from the nozzle 24. The cap 22 is threadably received on the nozzle stem 24 in the conventional fashion, and as the cap is rotated onto the nozzle stem the spray will become finer and, as it is rotated away from the nozzle stem, the spray will merge into a stream. This operation is described, for example, in U.S. Pat. No. 4,489,890 and U.S. Pat. No. 5,885,019, the disclosures which are incorporated herein by reference.

As shown in FIG. 2 for example, the scrubber device of this invention 26 is threadably received on the nozzle stem 24 in place of the cap 22. As shown in FIG. 2A an O-ring 28 is provided on the end of the nozzle stem 24 within a groove 30 so that when the scrubber device 26 is threadably received on the nozzle stem 24 the O-ring will frictionally retain the same against inadvertant rotation when the device is used with a scrubbing action.

In the preferred embodiment of this invention the scrubbing attachment 26 consists of a brush back 40 and a plurality of synthetic tufts 42 which are fused at their non-working ends and mounted on heat softened portions of the back 40 accordingly to the procedures described in the above identified Tucel patents. As will be obvious to those skilled in the art, however, a conventional staple brush may be mounted on the back 40 or in fact a sponge can be used instead of bristles. Furthermore, a combination of sponge with bristles therein could also be used on the brush back 40.

Figure 5:
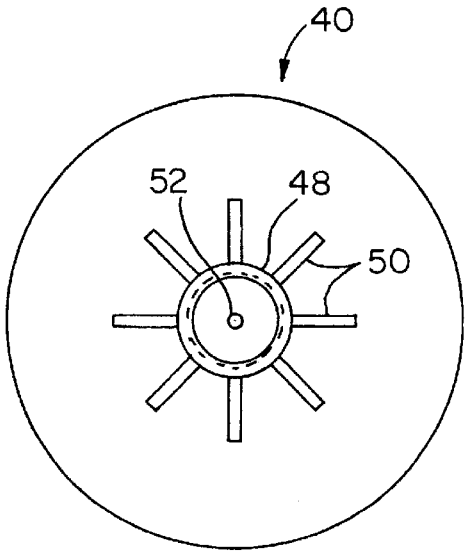
FIG. 5 is a rear view of the scrubbing attachment of FIG. 4.

The brush back 40 has a front surface 44 which in the preferred embodiment mounts a plurality of tufts 42. The rear surface 46 has a central cavity 48 which is internally threaded to be received on nozzle stem 24 and may have rigid supporting members 50 as shown for example in FIG. 5. Centrally of channel 48 is a liquid dispensing pinhole 52 which extends through the front face of scrubber 26 and is intended to register on the dispensing outlet of nozzle stem 24 when the scrubbing implement of this invention is threadably received on the nozzle stem 24. The device 26 then functions identically to the cap 22 whereby, when the device is rotated, the scrubbing attachment 26 is rotated onto the nozzle stem 24, it will alter the stream dispensed by the nozzle when the trigger 18 of 16 pump is squeezed against the bottle 12.

In the preferred embodiment of this invention the brush back 40 is round. However, the brush back could be square, triangular, or rectangular as desired.

Also, according to the preferred embodiment of this invention the scrubbing implement consists of a plurality of cut-to-length synthetic filaments having their non-working ends fused and mounted on a synthetic brush back whereby the scrubbing implement is a back with integral tufts extending therefrom. The entire pump and scrubbing attachment therein can be constructed of plastic material and can be recyclable. The scrubbing attachment of this invention can be mounted on any conventional pump sprayer dimensioned to threadably receive a cap member of the nozzle.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

What is claimed is:

1. In a hand held and actuated pump dispenser having an internal reservoir and a trigger actuated pump in communication with the reservoir, said pump having an opening mounting a dispensing nozzle therein including a threaded stem and a flow regulating rotatable cap mounted on said stem, the improvement comprising:

a removable scrubber having a front face and a rear face with an axial opening extending therethrough; mounting means carried by said scrubber for removably mounting said scrubber on said nozzle stem in place of said nozzle cap with said axial opening of said pump in registration with the dispensing opening communicating with said reservoir through said nozzle;

O-ring means mounted on said nozzle stem for frictionally retaining said scrubber threadably mounted on said nozzle stem, the axial opening through the front face being a pin hole;

abrading means mounted on the front face of said scrubber surrounding said opening; said abrading means including a plurality of mutually spaced, cut-to-length synthetic filament tufts extending integrally from the front face of said scrubber.

2. The scrubber of claim 1 wherein said nozzle stem is cylindrical and has external threads and said mounting means includes matching internal threads disposed within the axial opening adjacent the rear face of said scrubber.

3. The scrubber of claim 2 wherein said mounting means includes a sleeve with internal threads therein extending integrally from the rear face of said scrubber surrounding the axial opening.

4. The scrubber of claim 1 wherein each of said tufts has a working end and a non-working end, said non-working end being fused to said scrubber front face.

5. Method for fabricating a hand held and activated liquid dispensing pump with a scrubber thereon comprising the steps of:

providing a pump dispenser having an internal reservoir and a trigger activated pump in communication therewith, said pump having a dispensing nozzle including external threads and a threaded rotatable flow regulating nozzle cap;

providing a scrubber having a front face and a rear face, with an axial pin hole opening therethrough, said front face mounting abrading means surrounding said axial opening said rear face having rotable mounting means thereon surrounding said axial opening; said mounting means including internal threads adapted to receive said dispensing nozzle and an O-ring for frictional engagement with said nozzle when said nozzle is received in said scrubber;

removing the nozzle cap; and mounting said scrubber on said nozzle in place of said cap with the axial opening in registration with said nozzle so that said pump can dispense liquid through said nozzle and through the axial opening in said scrubber and into said abrading means with the position of said scrubber relative to said nozzle controlling the liquid dispensed.

* * * * *